US009849064B2

(12) United States Patent
Walker et al.

(10) Patent No.: US 9,849,064 B2
(45) Date of Patent: Dec. 26, 2017

(54) SYSTEM FOR JET HYDROTHERAPY

(71) Applicant: Custom Molded Products, Inc., Newnan, GA (US)

(72) Inventors: Victor L. Walker, Temecula, CA (US); Zachary T. Vogtner, Atlanta, GA (US)

(73) Assignee: Custom Molded Products, LLC, Newnan, GA (US)

( * ) Notice: Subject to any disclaimer, the term of this patent is extended or adjusted under 35 U.S.C. 154(b) by 312 days.

(21) Appl. No.: 14/532,731

(22) Filed: Nov. 4, 2014

(65) Prior Publication Data

US 2015/0352003 A1 Dec. 10, 2015

Related U.S. Application Data

(60) Provisional application No. 62/008,859, filed on Jun. 6, 2014.

(51) Int. Cl.

| | |
|---|---|
| ***A47K 3/00*** | (2006.01) |
| ***A61H 33/02*** | (2006.01) |
| ***A61H 33/00*** | (2006.01) |

(52) U.S. Cl.

CPC ..... *A61H 33/027* (2013.01); *A61H 33/0087* (2013.01); *A61H 33/6063* (2013.01)

(58) Field of Classification Search

CPC ..... A47K 3/10; A61H 33/02; A61H 33/025; A61H 33/026; A61H 2033/02

USPC ..... 4/541.1–541.6

See application file for complete search history.

(56) References Cited

U.S. PATENT DOCUMENTS

| | | | | |
|---|---|---|---|---|
| 3,540,438 | A * | 11/1970 | Jacuzzi | A61H 33/027 4/541.4 |
| 3,628,529 | A * | 12/1971 | Steimle | A61H 33/6063 4/559 |
| 4,907,305 | A * | 3/1990 | Teramachi | A61H 33/6063 137/171 |
| 2004/0025245 | A1* | 2/2004 | Pinciaro | F16L 41/03 4/541.6 |
| 2012/0005819 | A1* | 1/2012 | Yuhas | A61H 33/027 4/541.6 |
| 2012/0174312 | A1* | 7/2012 | Loyd | B05B 1/3026 4/541.6 |

* cited by examiner

*Primary Examiner* — Huyen Le

(74) *Attorney, Agent, or Firm* — Laurence P. Colton; Smith Tempel Blaha LLC

(57) ABSTRACT

A system for jet hydrotherapy configured to produce a fluid jet from an aerated fluid flow at sufficiently high velocities/pressures for massage or therapeutic treatment, which is accomplished by an internal geometry that places, at least, fluid and gas orifices, vessels and nozzles in the optimum location and configuration to create high fluid flow velocities throughout the system. The system also is configured to produce a fluid jet with sufficiently high gas content such that a user experiences less discomfort and/or pain when the fluid jet is applied to sensitive tissue areas. The system also is configured to provide a tactile interface upon which a system user can mechanically engage to supplement the jet hydrotherapy.

21 Claims, 23 Drawing Sheets

SYSTEM FOR JET HYDROTHERAPY

STATEMENT OF RELATED APPLICATIONS

This patent application claims priority on and the benefit of U.S. provisional patent application No. 62/008,859 having a filing date of 6 Jun. 2014.

BACKGROUND OF THE INVENTION

Technical Field

The present invention is directed generally to a system for jet hydrotherapy and more specifically to the components of the system configured to produce high air content/high velocity aerated fluid jets. The present invention also is directed to the components of a system for jet hydrotherapy configured as a tactile interface which a system user can mechanically engage to supplement the jet hydrotherapy.

Prior Art

Artificial water structures, such as conventional spas, hot tubs, whirlpool baths, swimming pools and the like, hereinafter referred to and defined as hydrotherapy tubs, comprise various components and features, such as jets. In the most common embodiments, jets for hydrotherapy tubs inject water together with air, if desired, against the bodies of users usually partially immersed therein. Such jets allow the users to control the water or aerated water input to the hydrotherapy tub.

By way of example, typical hydrotherapy tubs with jets mounted thereon or therethrough are constructed as a molded shell to form a water containment or fluid enclosure having a footwell or floor and an upstanding sidewall. Molded within the enclosure is at least one therapy station which may include a seat or platform for reclining. The shell typically is constructed of fiberglass, plastic, or a similar material, or a composite of such materials, forming a tub. One or more pumps usually are placed under the shell (the dry-side) to draw water from the hydrotherapy tub and discharge it, usually with air, into the hydrotherapy tub (the wet-side) through a plurality of jets of various types, including venturi-type jets such as water jet aerators. The jets usually are mounted through the shell in either or both of the floor and sidewall. Typically, jets mounted through the sidewall are located below the water line of the hydrotherapy tub. Moreover, jets usually are positioned on or about the therapy stations such that a user may readily engage with the jets.

Water jet aerators can be used in these hydrotherapy tubs to provide jets of aerated water to provide a massaging and therapeutic action. The massaging and therapeutic action usually is provided by water jet aerators that are recessed into the walls of the hydrotherapy tub. Several water jet aerators are usually spaced about the perimeter of the hydrotherapy tub. In some water jet aerators, the nozzles may be rotated to achieve a desired flow. The nozzle is often a swivel type nozzle, which allows the direction of the flow to be adjusted by the user of the hydrotherapy tub for maximum massaging or therapeutic action. The user often can adjust how the water jet aerators operate, for example, by selecting if the jets of aerated water discharge in a steady stream, in a pulsating manner, in combinations of a steady stream and pulsating manner, or in some type of alternating combination of steady stream and pulsating manner.

As already mentioned, one type of water jet aerator that is in common use in hydrotherapy tubs uses the venturi process. The venturi process involves mixing a stream of pressurized water with ambient air. This venturi type action occurs in an aeration chamber, with the air being drawn into a low pressure chamber from a passageway that is connected to the ambient atmosphere. The low pressure is created by the flow of water through the low-pressure chamber, across or by an opening for introducing the air. The mixture of pressurized water and air thereby provides an aerated jet of water, which then is discharged through a nozzle into the water contained in the hydrotherapy tub.

These venturi-type water jet aerators often are somewhat adjustable and may include a flow control system for manually adjusting the flow of air or water, or a combination of the air and water. For example, a first type of control system for a water jet aerator operates by manipulating the water flow and maintaining a steady, constant air flow through the aerator. A second type of control system adjusts both the air flow and the water flow simultaneously and proportionally. A third type of flow control system allows for independent adjustment of both the airflow and the water flow.

For the most part, water jet aerators are manufactured with a sealed single part body into which different nozzles can be inserted. The single part body is mounted on the spa in an orientation selected by the installer, or at random if the installer has no desired or instructed orientation. Also, many of the current water jet aerators generally produce aerated water that is about 80% water and 20% air which can be quite uncomfortable and/or painful when directed towards sensitive tissue areas like the wrists, neck, spine, hands, feet, behind the knee, facia tissue that connects muscle to bone, etc. Moreover, as already mentioned, the water jet aerators are typically recessed, which leave a user only engaging with the discharged aerated jet of water for massage or therapeutic treatment.

Accordingly, there is always a need for an improved system for jet hydrotherapy. For example, there is always a need for a water jet aerator that can produce a discharged aerated jet of water at a sufficient velocity/pressure for massage or therapeutic treatment that does not produce discomfort and/or pain in sensitive tissue areas. Additionally, there is always a need for a jet hydrotherapy system that can provide supplemental massage and/or therapeutic treatment besides the discharged aerated jet of water. It is to these needs, among others, that the present invention is directed.

BRIEF SUMMARY OF THE INVENTION

Briefly, the present invention is a system for jet hydrotherapy. In one illustrative embodiment, a system for jet hydrotherapy comprises a water jet housing with an aeration chamber for producing the aerated jet. The aeration chamber comprises a fluid inlet orifice, a gas inlet orifice, and an aerated fluid outlet channel. The fluid inlet orifice is configured to provide a fluid flow experiencing an increased velocity and a decreased pressure as it passes through a constriction. The gas inlet orifice is positioned proximal to the fluid inlet orifice and is configured to provide a gas flow. The aerated fluid outlet channel is configured to channel an aerated fluid outflow to the jet nozzle, which produces the aerated water jet into the hydrotherapy tub.

The aeration chamber has an internal geometry such that a gas flow is provided through the gas inlet orifice based, at least in part, on a fluid flow provided by the fluid inlet orifice and so as to result in an aerated fluid outflow through the aerated fluid outlet channel. The aeration may be a direct result of the venturi process; however, the internal geometry and combination of features in the aeration chamber leads to improved results, in terms of flow velocities and flow air content percentages, when compared to the prior art.

The internal geometry of the aeration chamber is also such that the gas flow and the fluid flow merge to form a vortical flow directed towards the aerated fluid outlet channel. The vortical flow, which draws in higher quantities of gas per quantity of fluid, when compared to the prior art, results in a greater aeration producing an aerated fluid flow with a higher percentage of air to water than the prior art. The internal geometry of the aeration chamber is also such that the velocity of the aerated fluid flow, as received by the aerated fluid outlet channel, is equal to or greater than the velocity of the fluid flow as received by the fluid inlet orifice.

The system for jet hydrotherapy additionally can comprise a fluid inlet zone and a gas inlet zone. The gas inlet zone is angled relative to the fluid inlet zone such that the gas from the gas inlet zone is more readily forced into the aeration chamber by, at least in part, the venturi process. The fluid inlet zone can have a progressively narrowing diameter towards the junction between the fluid inlet zone and the fluid inlet orifice such that the fluid flow into the aeration chamber is of higher velocity and lower pressure, which facilitates, at least in part, the venturi process.

The system for jet hydrotherapy also can comprise an aeration chamber in fluid communication with the aerated fluid outlet channel. The aeration chamber or a component of the aeration chamber can be configured to receive the fluid flow from the fluid inlet orifice and the gas flow from the gas inlet orifice. The aeration chamber also is configured to merge the gas flow and the fluid flow to form a vortical flow directed towards the aerated fluid outlet channel. The aeration chamber specifically has a progressively enlarging diameter away from the junction between the fluid inlet orifice, the gas inlet orifice, and the aeration chamber.

The system for jet hydrotherapy further can comprise an aerated fluid nozzle engaged with the aeration chamber at the largest diameter end of the aeration chamber. The aerated fluid nozzle comprises a preferably conical internal projection configured to extend into the aeration chamber such that a gap between the internal projection and the aeration chamber define the aerated fluid outlet channel of the aeration chamber.

The system for jet hydrotherapy additionally can comprise a therapy ring or face guard surrounding the aerated fluid nozzle. The therapy ring has a proximal end and a distal end. The proximal end is engaged with the jet housing while the distal end extends from the proximal end into or in the direction of the hydrotherapy tub such that the aerated fluid nozzle is recessed within the circumference of the therapy ring. The therapy ring is ergonomically configured to engage with a user's tissue.

These features, and other features and advantages of the present invention will become more apparent to those of ordinary skill in the relevant art when the following detailed description of the preferred embodiments is read in conjunction with the appended drawings in which like reference numerals represent like components throughout the several views.

DETAILED DESCRIPTION OF PREFERRED EMBODIMENTS

Embodiments and aspects of the present disclosure provide a system for jet hydrotherapy configured to create a unique therapy experience compared to what is presently available in the field. Unlike the prior art systems, the system of the present disclosure is configured to produce a fluid jet from an aerated fluid flow at sufficiently high velocities/pressures and with certain air to water aeration ratios for massage or therapeutic treatment. In certain embodiments, this is accomplished by a jet housing having a unique internal geometry that places, at least, fluid and gas orifices, chambers, and nozzles in an optimum location and configuration to create high fluid flow velocities of highly aerated fluid throughout the system. The unique internal geometry helps to form fluid and gas flow patterns that reduce turbulence, which increases fluid and gas flow velocities. Moreover, these high fluid flow velocities produce, at least in part, lower than normal pressures within the system, which induce a higher quantity of gas per quantity of fluid into the system through the venturi effect.

Furthermore, and directly related to the above, the system of the present invention also is configured to produce a fluid jet with sufficiently high gas content such that a user experiences less discomfort and/or pain when the fluid jet is applied to sensitive tissue areas. In certain embodiments, this is accomplished by a specific positioning, alignment, orientation and/or shaping of fluid and gas orifices, chambers, and nozzles to facilitate gas dispersion within the fluid. Although the fluid jet has a high velocity (as described above), the high gas content decreases the momentum of the fluid jet and enables a more pleasant hydrotherapy experience when directed towards a sensitive tissue area.

Additionally, the system of the present invention also is configured to provide a tactile interface which a system user can mechanically engage to supplement the jet hydrotherapy. In certain embodiments, this is accomplished by a therapy ring that, instead of being recessed, extends out towards a user and/or comprises a shaped external ring topography such that the user can rub/massage a tissue segment while also receiving jet hydrotherapy. For example, this is especially useful for supplemental reflexology type therapies.

Figure 1A:
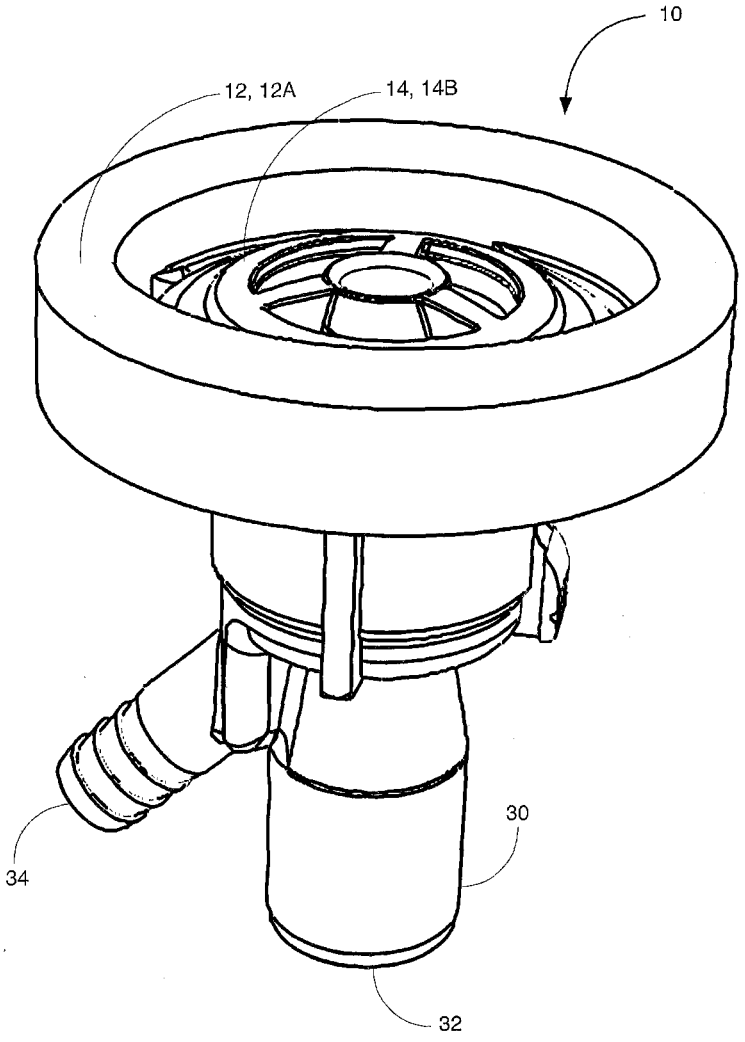
FIG. 1A is a perspective view of one embodiment of a system for jet hydrotherapy.
Figure 1B:
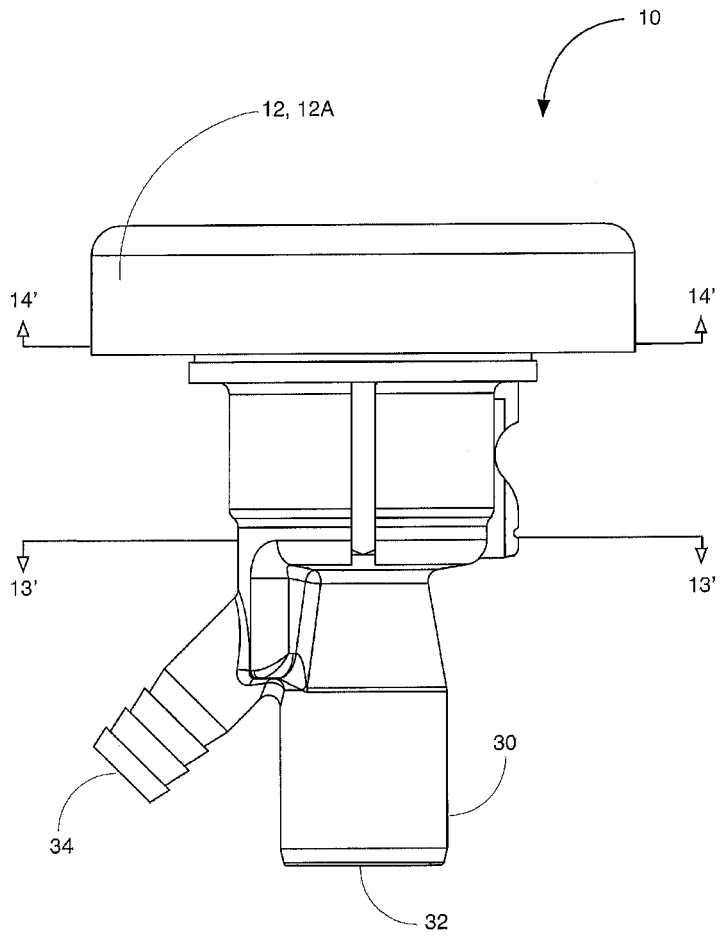
FIG. 1B is a side view of the embodiment of the system for jet hydrotherapy of FIG. 1.
Figure 1C:
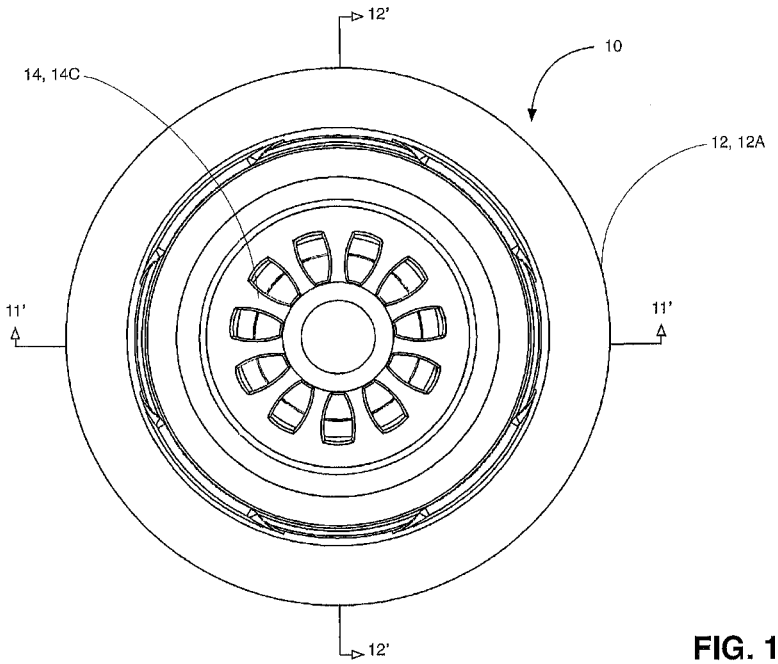
FIG. 1C is a top view of the embodiment of the system for jet hydrotherapy of FIG. 1.

Referring now to the drawings, wherein the showings are for purposes of illustrating the various embodiments of the present disclosure only and not for purposes of limiting the same, FIG. 1A is a perspective view of one embodiment of a system for jet hydrotherapy 10, FIG. 1B is a side view of the embodiment of FIG. 1A, and FIG. 1C is a top view of the embodiment of FIG. 1A. The system for jet hydrotherapy 10 is depicted as separate from any hydrotherapy tubs or other systems upon which it may be integrated or combined.

It is envisioned that the system for jet hydrotherapy 10 may be one contiguous discrete piece that is injection molded or 3D printed. It is also envisioned that that the system for jet hydrotherapy 10 may be a composite of multiple discrete and/or non-discrete component pieces that are permanently and/or detachably engaged with one another. A person having ordinary skill in the art recognizes that the system for jet hydrotherapy 10 may be made of any material(s); however, generally, the system is comprised of, or superficially lined by, plastic and or a corrosive resistant material(s). This is especially true for any region of the system for jet hydrotherapy 10 that will be in contact with a fluid or gas.

It is also envisioned that the dimensions of the system for jet hydrotherapy 10 are not limited by what is depicted in FIGS. 1A, 1B, and 1C. A person having ordinary skill in the art understands that the system for jet hydrotherapy 10 can be scaled in size for any application or use. The system for jet hydrotherapy 10 may be entirely or partial modular with the modules entirely fungible.

As can be seen in FIGS. 1A, 1B, and 1C, the system for jet hydrotherapy 10 comprises a jet housing 30 having a fluid inlet zone 32 and a gas inlet zone 34. Preferably, water is introduced into the jet housing 30 through the fluid inlet zone 32 and air is introduced into the jet housing through the gas inlet zone 34. Upon mixing of the fluid and gas within the jet housing 30 as disclosed herein, the aerated fluid is ejected out of the system for jet hydrotherapy 10 through the aerated fluid nozzle 14, which can be of various selected configurations depending on the desired pattern of aerated fluid jet desired, with FIG. 1A illustrating a three port face fan 14B for the nozzle 14 and FIG. 1C illustrating a multi-port face fan 14C for the nozzle 14. A therapy ring 12, or face guard, is located at the exit end of the jet housing 30 and surrounds the nozzle 14, which therapy ring 12 can also serve to add a mechanical therapy or stimulus to the user of the system for jet hydrotherapy 10, with FIGS. 1A, 1B, and 1C illustrating a smooth therapy ring 12A.

Figure 2:
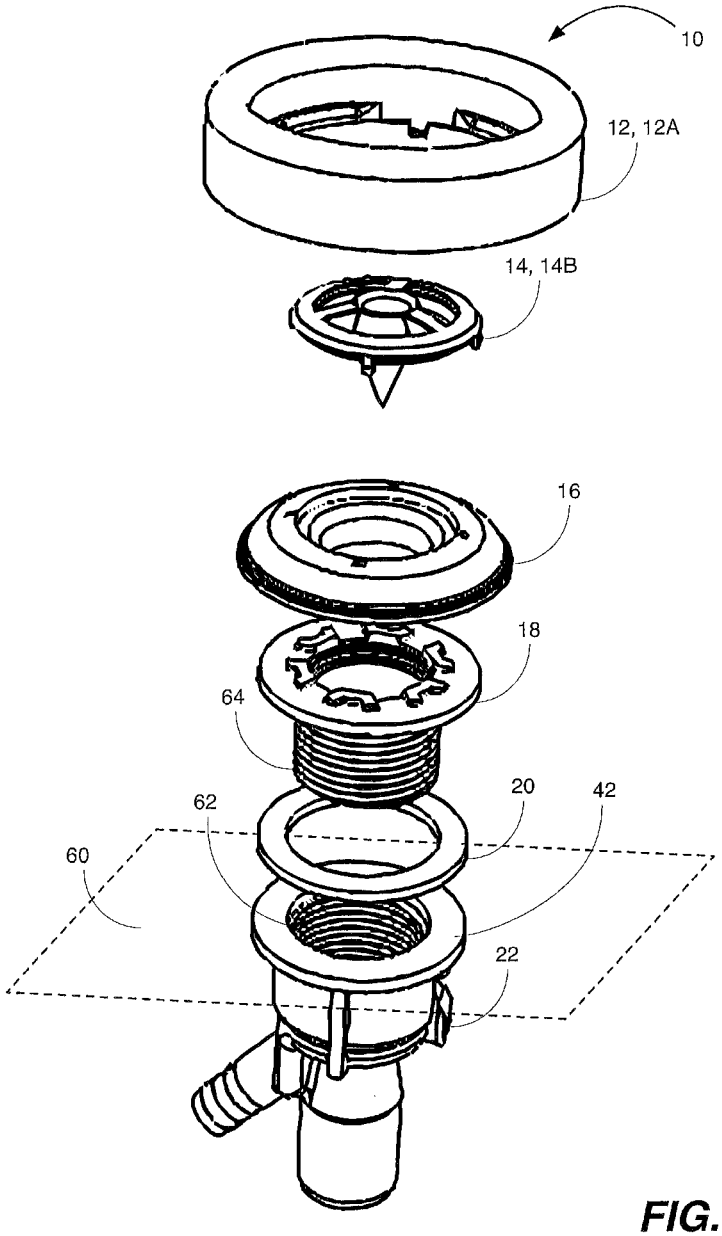
FIG. 2 is an exploded perspective view of the system for jet hydrotherapy of FIG. 1.

FIG. 2 is an exploded perspective view of the system for jet hydrotherapy 10 of FIG. 1 exploded so as to show the structural relationship of primary component pieces. Any component pieces not illustrated are omitted simply to not obscure the figure and should not be considered a limitation of the present disclosure. A preferred embodiment of the system for jet hydrotherapy 10 comprises a therapy ring 12, an aerated fluid nozzle 14, a flange 16, a wall fitting 18, a gasket 20, and a body 22. When the aerated fluid nozzle 14, the flange 16, the wall fitting 18, the gasket 20, and the body 22 are assembled, the resulting component piece of the system for jet hydrotherapy 10 is one embodiment of a jet housing 30.

When attached to a hydrotherapy tub (not shown in its entirety), namely, on a tub wall 60 or shell, the jet housing 30 is located on the outside (dry side) of the tub wall 60 proximal to a hole made through the tub wall 60 for accommodating the system 10. The internal wall of the jet housing 30 can comprise, at least in part, a threaded portion 62 for cooperating with a threaded portion 64 on at least a portion of the external wall of the wall fitting 18. A gasket 20 is placed either over the threaded portion 64 of the wall fitting 18 or about the hole through the tub wall 60 on the inside (wet side) of the tub wall 60 whereby the wall fitting 18 is inserted through the gasket 20 and the hole through the tub wall 60 and then is screwed into the jet housing 30, sandwiching the tub wall 60 between the gasket 20 and the jet housing 30, thereby securing the jet housing 30 and wall fitting 18 to the tub wall 60. Alternatively, a friction fit can be used between the wall fitting 18 and the jet housing 30, or other fits or connection mechanisms known in the art. The flange 16 then is secured to the wall fitting 18, and the selected aerated fluid nozzle 14 secured to the flange 16. A therapy ring 12, if desired, then is secured to the flange 16.

Figure 3:
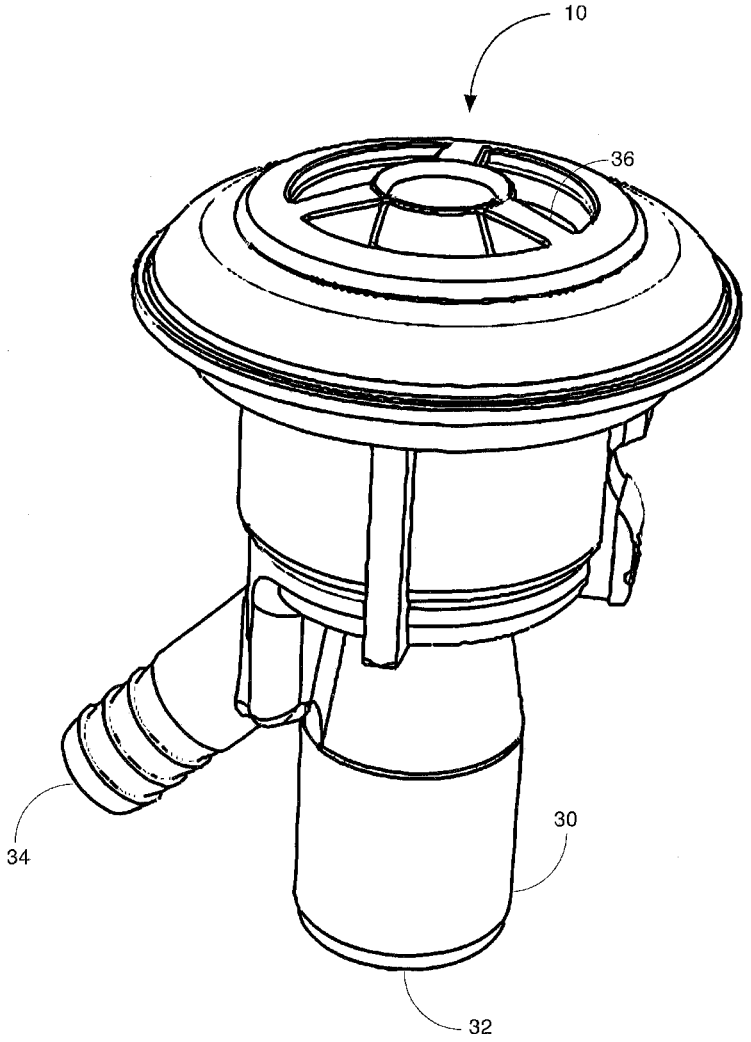
FIG. 3 is a perspective view of one embodiment of a jet housing of the system for jet hydrotherapy of FIG. 1 including a face fan.

FIG. 3 illustrates an embodiment of the jet housing 30 having a fluid inlet zone 32, a barbed gas inlet zone 34 (for easy attachment of a gas line, as is understood by one having ordinary skill in the art), an aeration chamber 40 (not visible from this view) and an aerated fluid outlet channel 36. The therapy ring 12 is not show so as to provide a better view of the aerated fluid nozzle 14 and the flange 16 in a preferred attachment configuration to the wall fitting 18. Although the fluid inlet zone 32 and the gas inlet zone 34 are depicted as being part of the jet housing 30, the jet housing 30 is not limited to this architecture. The same is applicable to the aerated fluid outlet channel 36, which is depicted as being part of the junction between the aerated fluid nozzle 14, the flange 16, and the wall fitting 18. The jet housing 30 may be engaged with any hydrotherapy tubs or other systems via any means known to one having ordinary skill in the art. This may include flexible hoses, pipes, clips, adhesives, fasteners, weldings, vessels, channels, etc.

Figure 4:
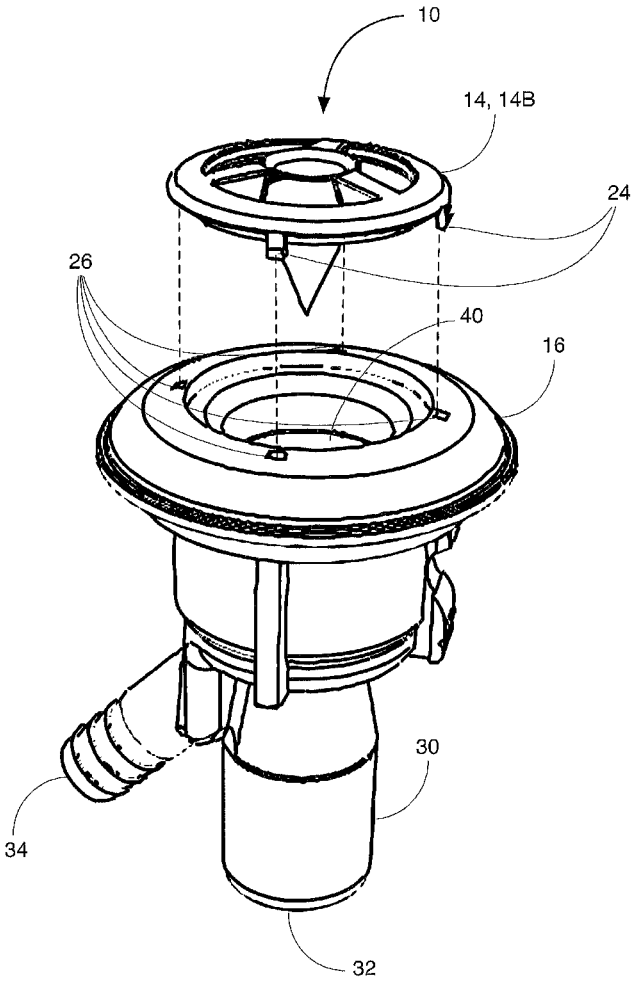
FIG. 4 is an exploded perspective view of the embodiment of the jet housing of FIG. 3.

FIG. 4 is an exploded perspective view of one embodiment of the system 10 as shown in FIG. 3, wherein the aerated fluid nozzle 14 is disengaged from the flange 16. An embodiment of the aerated fluid nozzle 14 comprises male snap components 24 for engaging with female snap components 26 on flange 16 whereby aerated fluid nozzle 14 can be releasably secured to flange 16. Although the male snap components 24 are shown in the nozzle 14 and the female snap components 26 are shown on the flange 16, these can be reversed. Also, although four snap components 24, 26 are shown, this is not a required number. Further, alternative methods of connecting the nozzle 14 to the flange 16 can be used, such as pins, clips, threads, twist-locks, and other attachment means known in the art. In this particular embodiment of the jet housing 30, an aeration chamber 40 is visible. One having ordinary skill in the art understands that the aeration chamber 40 is not necessarily associated with any of the described, or not described, components, modules, and/or regions of the jet housing 30.

Figure 5:
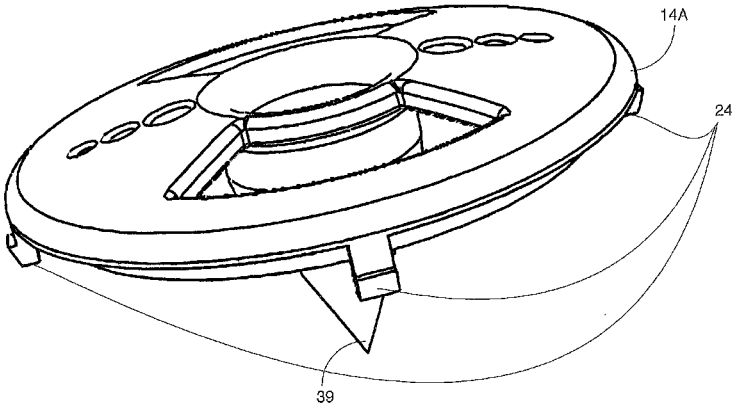
FIG. 5 is a perspective view of an embodiment of the aerated fluid nozzle of the jet housing of FIG. 4, specifically, a two port nozzle.
Figure 6:
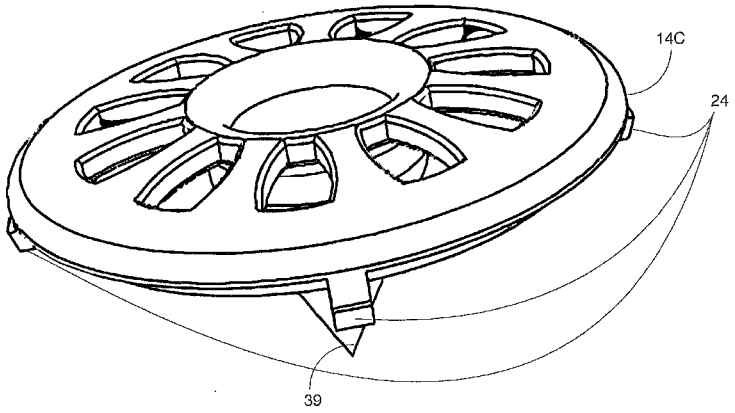
FIG. 6 is a perspective view of an embodiment of the aerated fluid nozzle of the jet housing of FIG. 4, specifically, a multi-port nozzle.
Figure 7:
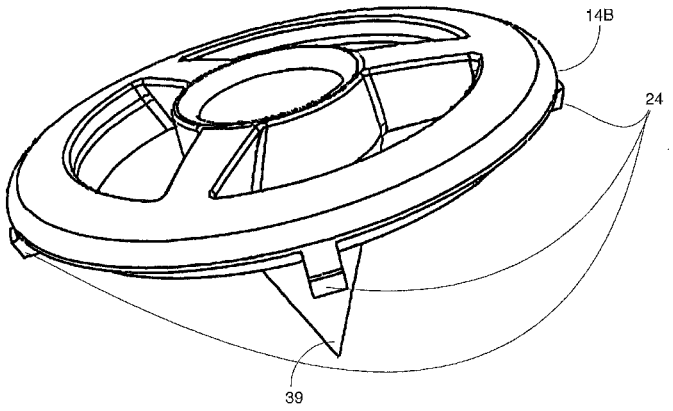
FIG. 7 is a perspective view of an embodiment of the aerated fluid nozzle of the jet housing of FIG. 4, specifically, a three port nozzle.

FIGS. 5, 6, and 7 are perspective views of three different illustrative embodiments of the aerated fluid nozzle 14. More specifically, FIG. 5 is a perspective view of a binetic nozzle 14 or two port face fan 14A, FIG. 6 is a perspective view of a polynetic nozzle 14 or multi-port face fan 14C, and FIG. 7 is a perspective view of a trinetic nozzle 14 or three port face fan 14B. It is understood by one having ordinary skill in the art that the aerated fluid nozzle 14 may take many different shapes and configurations to produce different variations of hydrotherapy jet shapes and patterns. The aerated fluid nozzle 14, therefore, is configured to produce a fluid jet with a velocity equal to or greater than the velocity of the aerated fluid flow as received from the aeration chamber 40. Moreover, the aerated fluid nozzle 14 is also configured to work effectively with high air content aerated fluid flows as disclosed herein. The male snap components 24 on nozzles 14 allow a user to remove and replace the nozzle 14 as desired.

Figure 8:
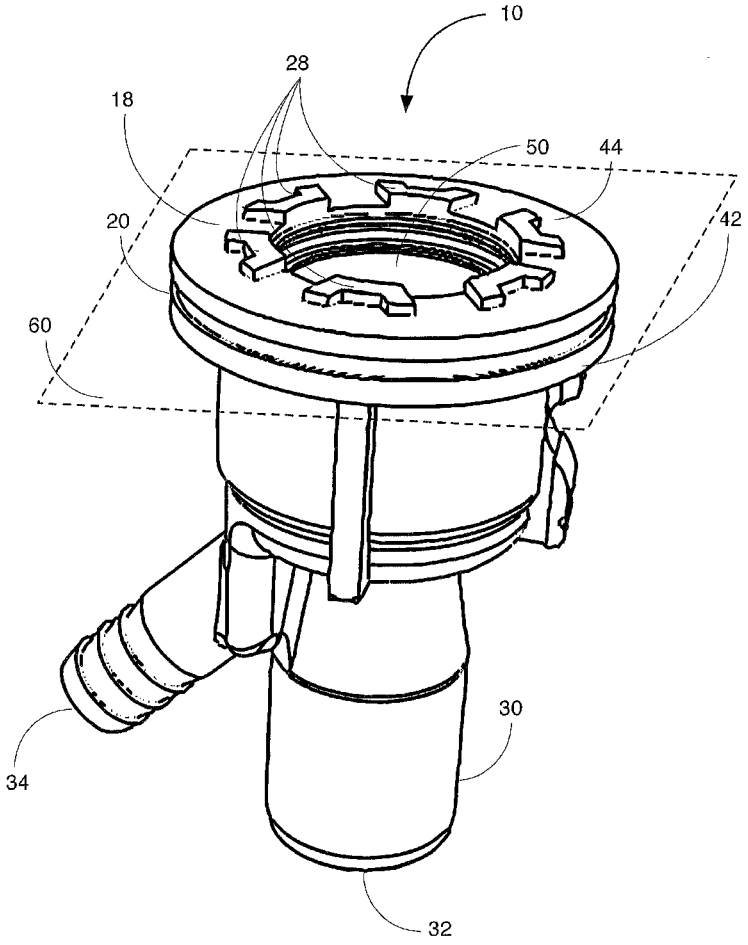
FIG. 8 is a perspective view of one embodiment of the jet housing of FIG. 3 in conjunction with a wall fitting for securing the jet housing on a tub shell.

FIG. 8 is a perspective view of one embodiment of the jet housing 30, gasket 20, and wall fitting 18 secured together on a tub wall 60, but without the aerated fluid nozzle 14, the flange 16, or the therapy ring 12 so as to provide more detail. In this particular embodiment of the jet housing 30, an aerated fluid dispersion chamber 50 located within the interior of the jet housing 30 is visible. One having ordinary skill in the art understands that the aerated fluid dispersion chamber 50 is not necessarily associated with any of the described or not described components, modules, and/or regions of the jet housing 30. As can be seen, when wall fitting 18 is attached to jet housing 30, tub wall 60 is sandwiched between gasket 20 and an upper flange 42 of jet housing 30 so as to secure the system 10 on the tub wall 60. Chairs 28 are located on an upper surface 44 of wall fitting 18 to support flange 16 at a desired distance above the upper surface 44 of wall fitting 18.

Figure 9:
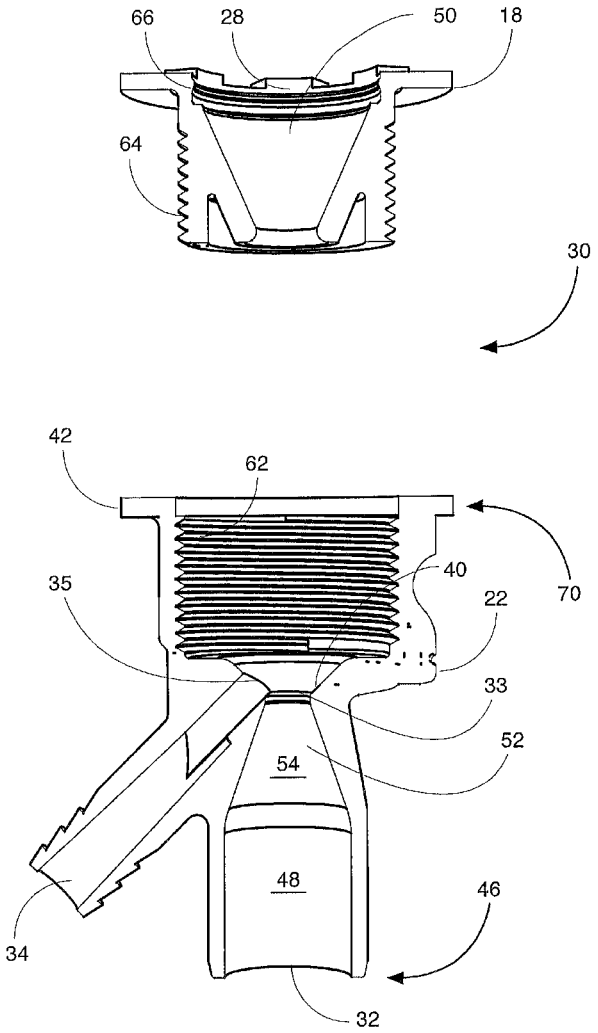
FIG. 9 is a side sectional side view of an exploded embodiment of the jet housing and wall fitting of FIG. 8.
Figure 10:
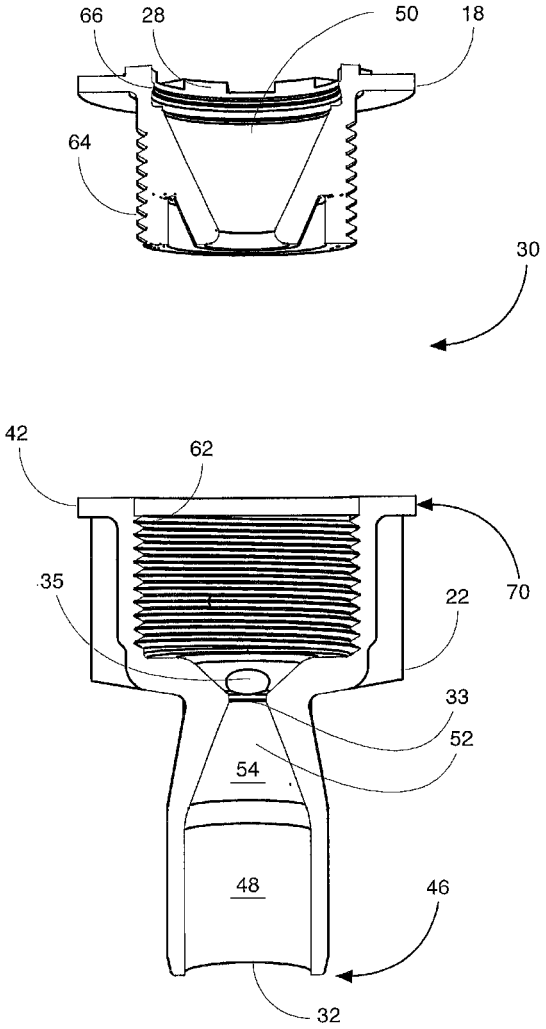
FIG. 10 is a front sectional view of an exploded embodiment of the jet housing and wall fitting of FIG. 8, rotated 90° from FIG. 9.

FIGS. 9 and 10 are a side sectional view and a front sectional view of an exploded embodiment of the jet housing 30 and wall fitting 18 of FIG. 8, but without the aerated fluid nozzle 14, the flange 16, the therapy ring 12, or the gasket 20 so as to provide more detail, and wherein the wall fitting 18 is disengaged from the jet housing 30. In these views, the threaded portion 62 of jet housing 30 and the threaded portion 64 of wall fitting 18 are shown in greater detail. Wall fitting 18 further can comprise a threaded or ridged attachment section 66 for cooperating with the flange 16 whereby the flange 16 can be releasably secured to the wall fitting 18.

FIGS. 9 and 10 also illustrate the internal configuration of preferred embodiments of the jet housing 30 and the wall fitting 18. Starting from the inlet end 46 of the jet housing 30, fluid inlet zone 32 and gas inlet zone 34 allow fluid and gas, respectively, to be introduced to the generally hollow interior 52 of the jet housing 30. Fluid inlet zone 32 comprises a fluid manifold 48 into which the fluid is first introduced to the jet housing 30 at a first flow rate and pressure. The fluid next travels through a funnel-shaped constricting zone 54, which increases the flow rate and lowers the pressure of the fluid flow. The fluid next travels through a fluid inlet orifice 33 into a funnel-shaped aeration chamber 40 having an increasing diameter opposite the decreasing diameter of the constricting zone 54, which decreases the flow rate and increases the pressure of the fluid flow, creating a venturi effect at the gas inlet orifice 35.

Gas inlet zone 34 comprises a gas manifold 68 into which the gas is first introduced to the jet housing 30. The gas may be provided at a set flow rate and pressure, or may simply be made available in the manifold 68 at a gas inlet orifice 35. If the gas is provided at a positive flow rate and pressure, the gas next travels through the gas inlet orifice 35 into the aeration chamber 40. However, as the fluid is traveling through the aeration chamber 40 at a positive flow rate and pressure, the venturi effect created as the fluid passes by the gas inlet orifice 35 can cause a negative pressure across the gas inlet orifice 35, thus causing the gas to be pulled into the aeration chamber 40. Within the aeration chamber 40, the gas and the fluid mix, resulting in an aerated fluid. As discussed in more detail herein, the aerated fluid then travels into to the aerated fluid dispersion chamber 50 of the wall fitting 18.

A preferred embodiment of the wall fitting 18 comprises an aerated fluid dispersion chamber 50 having a conical geometry, shape, or configuration. Therefore, one having ordinary skill in the art understands that the aerated fluid dispersion chamber 50 of the jet housing 30 may, in certain embodiments, be part of various described, or not described, components, modules, and/or regions of the wall fitting 18 or of the jet housing 30. It is, however, also understood that the aerated fluid dispersion chamber 50 may, in certain embodiments, be part of a single discrete component, module, and/or region of the wall fitting 18 or of the jet housing 30. In the illustrative embodiments shown herein, the wall fitting 18 component comprises at least a portion of the aerated fluid dispersion chamber 50, which cooperates with the aeration chamber 40 located within the jet body 30.

Figure 11:
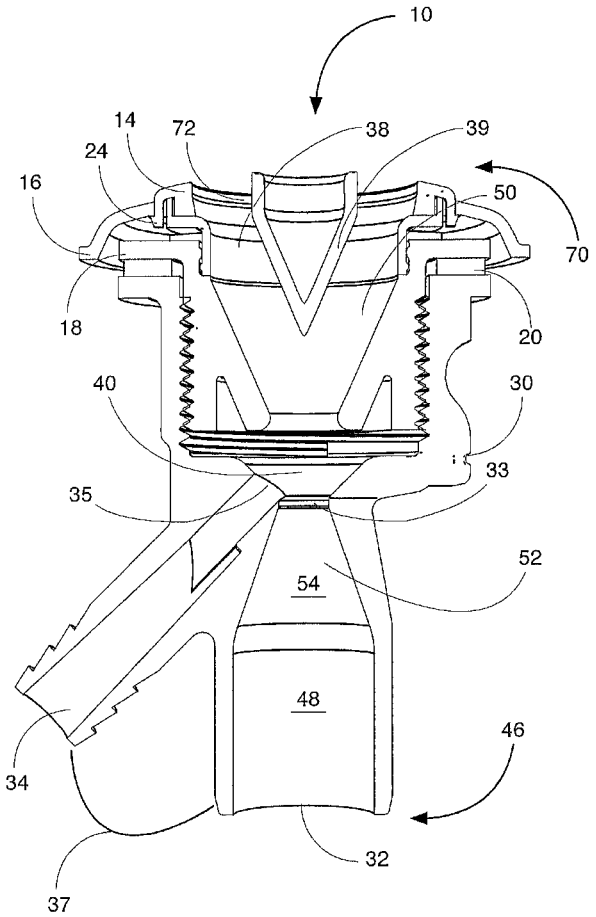
FIG. 11 is a side sectional view of the jet housing and face fan of FIG. 3 along line 11'-11' of FIG. 1C.
Figure 12:
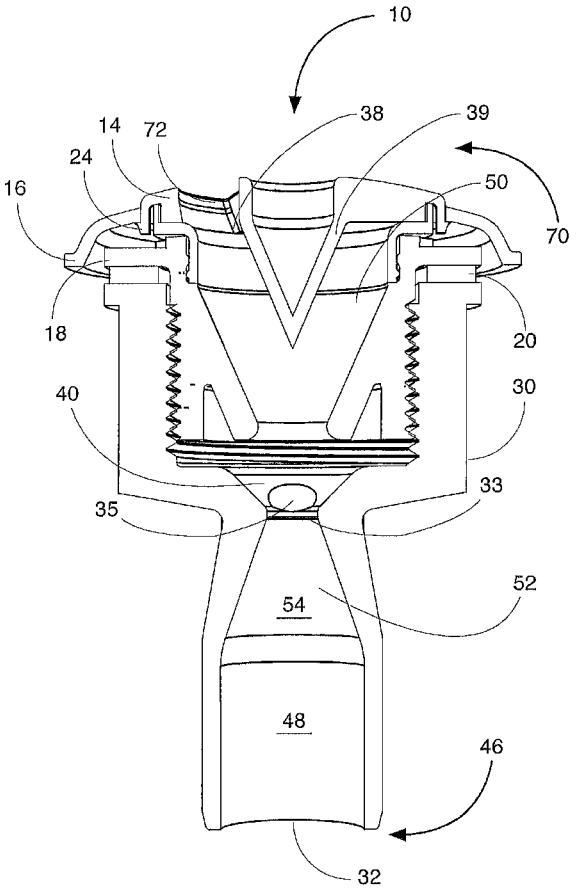
FIG. 12 is a front sectional view of the jet housing and face fan of FIG. 3, rotated 90° from FIG. 11 and along line 12'-12' of FIG. 1C.
Figure 13:
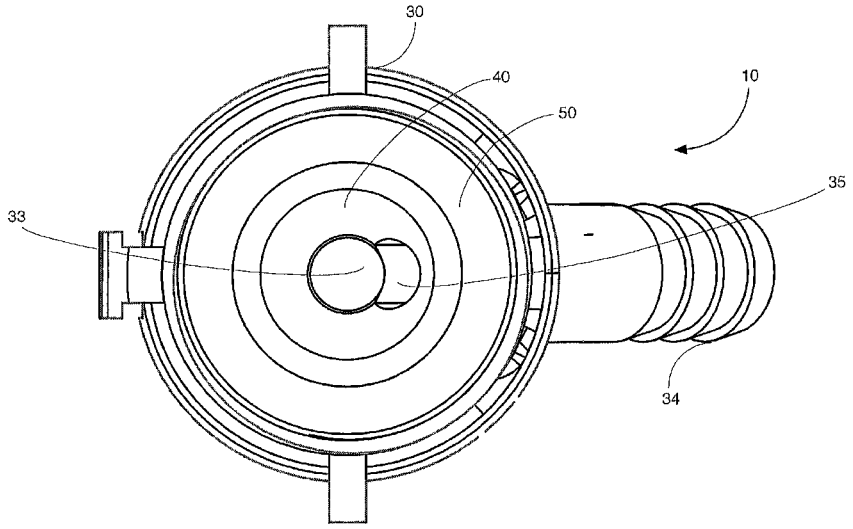
FIG. 13 is a top sectional view of the jet housing of FIG. 3 along line 13'-13' of FIG. 1B.
Figure 14:
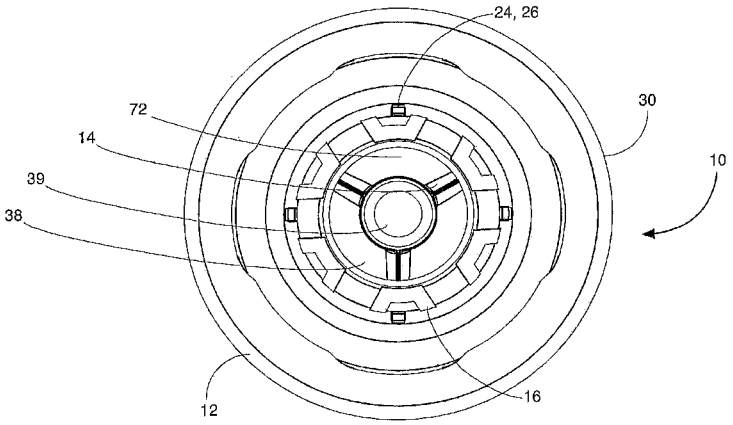
FIG. 14 is a bottom sectional view of the jet housing of FIG. 3 along line 14'-14' of FIG. 1B.
Figure 15:
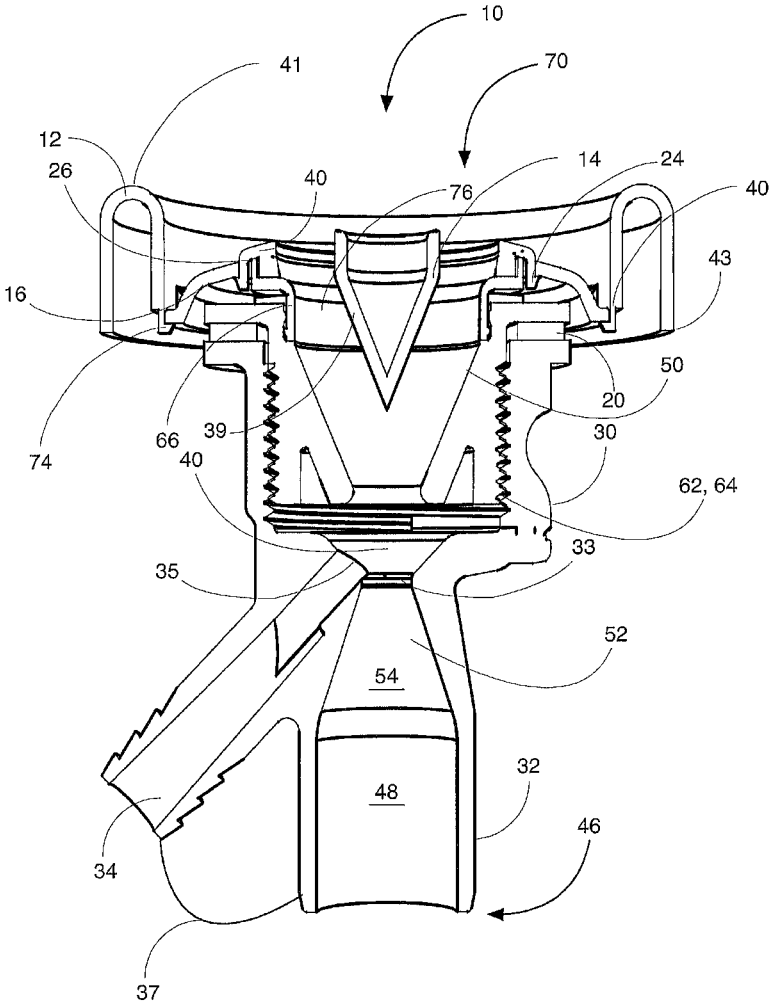
FIG. 15 is a side sectional view of the system for jet hydrotherapy of FIG. 1 along line 11'-11' of FIG. 1C.

FIGS. 11, 12, 13, 14, and 15 are sectional views of an illustrative embodiment of the system 10 with the wall fitting 18 combined with the jet housing 30 in a typical configuration suitable for use. FIGS. 11 and 12 do not show a therapy ring 12 and FIG. 15 shows a therapy ring 12. As can be understood through these figures, a gas flow is introduced to the aeration chamber 40 through the gas inlet zone 34 concurrently as a fluid flow is introduced to the aeration chamber 40 through the fluid inlet zone 32. The aeration chamber 40 comprises a fluid inlet orifice 33 and a gas inlet orifice 35 each, respectively, in fluid communication with the fluid inlet zone 32 and the gas inlet zone 34. It is envisioned that the fluid inlet orifice 33 and the gas inlet orifice 35 may have any shape, size and/or configuration necessary to provide for a desired or necessary fluid flow or a gas flow, respectively.

As can be seen in FIGS. 11 and 12, the fluid inlet zone 32 has a narrowing diameter through the fluid manifold 48 and the constricting zone 52 towards the fluid inlet orifice 33. One having ordinary skill in the art understands that, therefore, the fluid inlet orifice 33 is configured to receive a fluid flow experiencing an increased velocity and a decreased pressure as it passes through the constriction zone 54 of the jet housing 30. It is envisioned that the decreased pressure of the fluid flow upon entering the aeration chamber 40 facilitates, at least in part, the venturi effect, which forces the gas flow into the aeration chamber 40. Additionally, the constriction zone 54 and the decreased diameter fluid inlet orifice 33 create a higher flow rate through the system 10 and therefore out of the aerated fluid nozzle 14.

Also facilitating the venturi effect, at least in part, is the proximity of the gas inlet orifice 35 to the fluid inlet orifice 33 and the angled configuration (element 37) of the gas inlet zone 34 relative to the fluid inlet zone 32. Element 37 represents the angle defined by the gas inlet zone 34 and the fluid inlet zone 32. It is envisioned that the angle may be between 0.0 degrees and 90 degrees, and preferably between 25 degrees and 60 degrees, with approximately 35 degrees to 45 degrees being desired. Prior art and typical jet housings have fluid inlets and gas inlets that are 90 degrees to the axis of the jet housing. Thus, both the fluid inflow and the gas inflow are at 90 degrees relative to the axis of the jet housing. Other prior art and typical configurations provide for a fluid inflow that is parallel to the axis of the jet housing and a gas inflow that is 90 degrees to the axis of the jet housing, and therefore 90 degrees to the fluid inflow to the jet housing. Such prior art and typical configurations do not create as efficient a venturi effect on the gas inflow, and therefore do not create an aerated fluid having a greater gas content as produced by the present system 10 and as disclosed herein.

The aeration chamber 40 is defined by an internal geometry, shape, or configuration that, at least in part, enables the aeration chamber 40 to force a gas flow, through the gas inlet zone 34, into the aeration chamber 40 when a fluid flow is received by the aeration chamber 40 through the fluid inlet zone 32 and when a fluid flow is expelled out of the aeration chamber 40. Moreover, the aeration chamber 40 may be similarly enabled to produce gas and fluid flow patterns within the aeration chamber 40 such that turbulence is reduced or increased, an aerated fluid flow is produced and flow velocities, throughout the jet housing 30, are maximized. One having ordinary skill in the art understands that maximizing the velocities of the flows is directly related, at least in part, to decreased flow pressures in the aeration chamber 40 which, in turn, induces a higher quantity of gas per quantity of fluid into the aeration chamber 40 than the prior art. Moreover, the aeration chamber 40 may be similarly enabled to produce an aerated fluid flow with a gas content between 40.0% and 90.0%, and preferably a gas content of between 70.0% and 90.0%, with a gas content of approximately 80% being desirable. Thus, the prior art jet housings can only produce an aerated fluid flow of high gas content by forcing more gas into the jet, requiring additional pumps and components. The angled configuration of the gas inflow and the fluid inflow of the present invention, coupled with the venturi aeration chamber 40 creates a higher gas content in the resulting aerated fluid flow without such additional components.

The aeration chamber 40 and the aerated fluid dispersion chamber 50 may be structured so as to produce a vortical flow, namely a swirling of the aerated fluid within the aeration chamber 40 and the aerated fluid dispersion chamber 50, from the gas and fluid flows, about the conical geometry, shape, or configuration. One having ordinary skill in the art understands that a vortical flow about the conical geometry, shape, or configuration can reduce turbulence and pressure and increase the velocity of the flows within the aerated fluid dispersion chamber 50. Such a vortical flow also can result in a better mixing of the gas and the fluid, resulting in a more homogenous aerated fluid flow.

Once the fluid flow and the gas flow enter the aeration chamber 40, the fluid undergoes aeration, and the aerated fluid, or the fluid being aerated, is directed by the incoming fluid and gas towards the conical geometry, shape, and configuration of the aerated fluid dispersion chamber 50. This flow ultimately results in additional mixing of the fluid and gas flows to produce the aerated fluid flow, which is then directed towards the aerated fluid nozzle 14 for fluid jet production. One having ordinary skill in the art understands that, therefore, the aeration chamber 40 additionally comprises an aerated fluid outlet channel 38 configured to channel an aerated fluid flow towards the aerated fluid nozzle for ejection out of the system 10. In this particular embodiment of the aeration chamber 40, the aerated fluid outlet channel 38 is generally formed within the aerated fluid dispersion chamber 50.

The aerated fluid nozzle comprises an internal projection 39 in the form of a cone extending downward from the aerated fluid nozzle 14 into the aerated fluid dispersion chamber 50. In a preferred embodiment, the internal projection 39 is a scaled conical shape similar to the conical shape of the aerated fluid dispersion chamber 50, namely, having a similar slope to the conical sides. Internal projection 39 forces the aerated fluid flow from the aeration chamber 40 to diverge outwardly within aerated fluid dispersion chamber 50 whereby the aerated fluid flow will exit the system through the various ports 72 on the aerated fluid nozzle 14. One result of this divergent flow is that the aerated fluid being ejected from the system 10 is more likely to have a consistent flow velocity, namely, such a divergent flow helps to eliminate a higher inner flow velocity that may result in any of the aerated fluid flow leaving through a central port. One having ordinary skill in the art understands that the internal projection 39 may take various different shapes and configurations, as long as the internal projection 39 cooperates with the inner wall of the aerated fluid dispersion chamber 50.

FIG. 15 is a cross sectional side view of the entire system for jet hydrotherapy 10 of the present invention. The various components of the system 10 are connected as disclosed previously herein, with wall fitting 18 being screwed into jet housing 30 thereby sandwiching tub wall 60 between gasket 20 and upper flange 42 of jet housing 30. The connection between wall fitting 18 and jet housing 30 need not be threaded portions 62, 64, but can be a friction fit, ridges and notches, bumps and grooves, and any of the other known manners for attaching parts together. Flange 16 is removably attached to wall fitting 18, such as by inserting a cylindrical projection 76 of flange 16 into the attachment section 66 of wall fitting 18 using known attachment means such as threaded portions, friction fit, ridges and notches, bumps and grooves, and any of the other known manners for attaching parts together.

An aerated fluid nozzle 14 is selected based on the type of hydrotherapy desired. For example, three illustrative aerated fluid nozzles 14A, 14B, 14C are disclosed herein, each of which can provide a different aerated fluid flow type and/or pattern. The presence of fewer ports 72 on aerated fluid nozzle 14 can provide for a stronger (greater flow rate) stream of aerated fluid; the presence of many smaller ports 72 on aerated fluid nozzle 14 can produce many stronger (greater flow rate) streams of aerated fluid; and the presence of many larger ports 72 or one or two very large ports 72 can produce weaker (lesser flow rate) streams of aerated fluid. The aerated fluid nozzle 14 is attached to the flange 16 using, for example, the male snap components 24 and the female snap components 26.

A therapy ring 12 is selected based on whether and what type of additional mechanical stimulation or therapy is desired. As disclosed herein, a smooth therapy ring 12A can provide simple massage when the user presses or rubs the chosen body part (wrist, for example) against the distal end 41 of the therapy ring 12A. A scalloped therapy ring 12B can provide a more complex massage. Ridged or bumped therapy rings 12, as well as other patterns, are also contemplated. The therapy ring 12 is engaged to the flange 16 via clip projections 74 located on an inner portion of a proximal end 43 of the therapy ring 12 proximal to both the flange 16 and the tub wall 60. The distal end 41 of the therapy ring 12 is elevated from the proximal end 43 of therapy ring 12 such that the distal end 41 extends away from the jet housing 10 and the tub wall 60. Therefore, the aerated fluid nozzle 14 and the flange is recessed within the circumference of the therapy ring 12, which leaves a space between the plane of the distal end 41 and the aerated fluid nozzle 14. As discussed in more detail herein, the therapy ring 12 may take any shape, dimension, and/or configuration needed so that the therapy ring 12 functions as a tactile interface upon which a system user can mechanically engage (to supplement the jet hydrotherapy) without interfering with the performance of the aerated fluid nozzle 14.

The aerated fluid nozzle 14 and the therapy ring 12 are attached independently to the flange 16, and can be removed independently as well. In this configuration, a user can switch aerated fluid nozzles 14 without having to detach the therapy ring 12, and a user can switch therapy rings 12 without having to detach the aerated fluid nozzle 14.

The combination of the constriction zone 54 and the decreased diameter fluid inlet orifice 33 create a higher flow rate through the system 10 and therefore out of the aerated fluid nozzle 14. The combination of the placement and angle of the fluid inlet zone 32 and the gas inlet zone 34 with the venturi structure aeration chamber 40 allows a higher gas inflow to the aeration chamber 40, therefore imparting a higher gas content to the aerated fluid. As a result, the combination of the higher flow rate of the aerated fluid and the higher gas content of the aerated fluid results in a relatively high flow rate aerated fluid flow against the user. When the aerated fluid is described as having a higher gas content, what is meant is that the aerated fluid has a higher gas bubble content, not a higher dissolved gas content (although this also may be the case).

Figure 16:
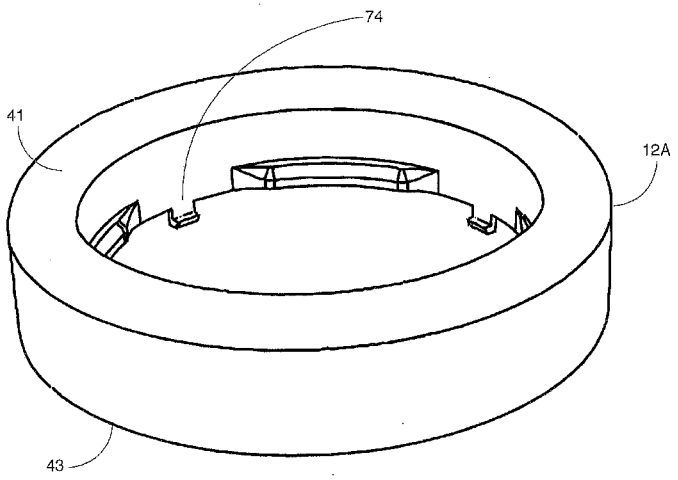
FIG. 16 is a perspective view of an embodiment of a smooth therapy ring suitable for use with the present invention.
Figure 17:
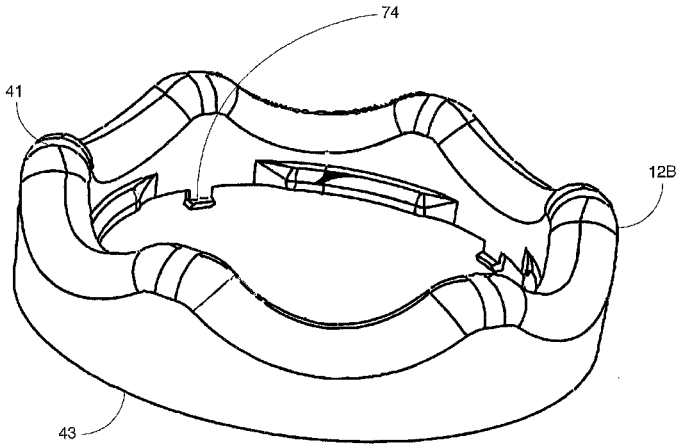
FIG. 17 is a perspective view of an embodiment of a scalloped therapy ring suitable for use with the present invention.

FIGS. 16 and 17 are perspective views of different illustrative embodiments of the therapy ring 12, with FIG. 16 showing a smooth therapy ring 12A and FIG. 17 showing a scalloped therapy ring 12B. It is understood by one having ordinary skill in the art that the therapy ring 12 may take many different shapes and configurations so that the therapy ring 12 can ergonomically engage with a system user's tissue. As stated above, because the therapy ring 12 functions as a tactile interface upon which a system user can mechanically engage, a smooth therapy ring 12A may provide a rounded distal end 41 upon which a system user can rub against to supplement the jet hydrotherapy. Similarly, a scalloped therapy ring 12B may provide undulations about a rounded distal end 41 that conform to any rounded tissue segments of a system user. Moreover, a scalloped therapy ring 12B may provide undulations about a rounded distal end 41 that impart points of high and low mechanical pressure when rub up against (to further protect sensitive tissue areas). The rubbing action may promote blood flow and the removal of harmful chemicals that may become built up in the wrist area due to repetitive motion disorders.

Figure 18:
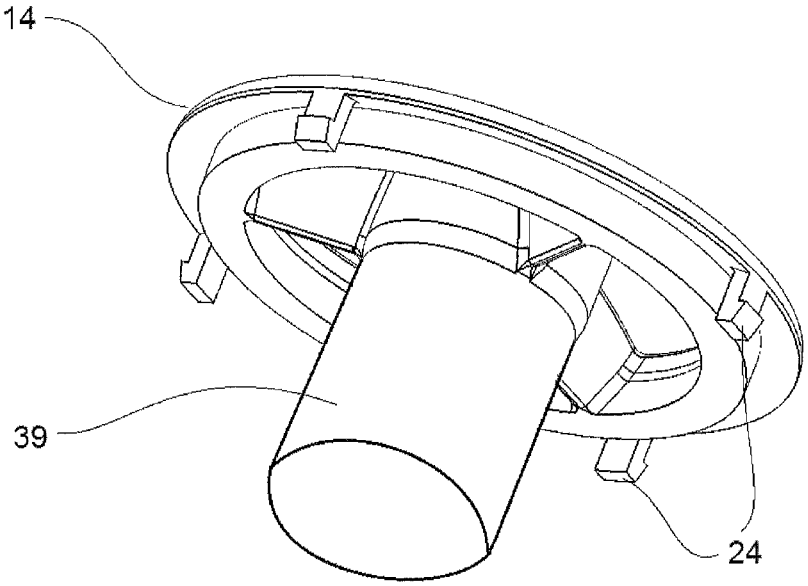
FIG. 18 is a perspective view of an alternate embodiment of the aerated fluid nozzle.
Figure 19:
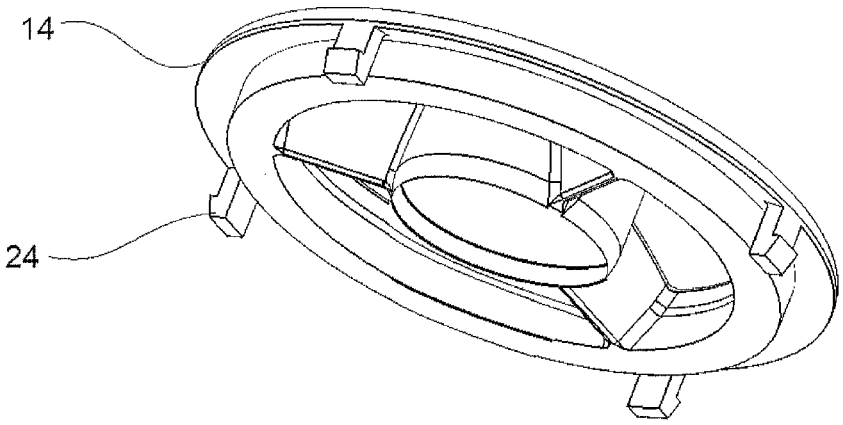
FIG. 19 is a perspective view of an alternate embodiment of the aerated fluid nozzle.

FIG. 18 is a perspective view of an alternate embodiment of the aerated fluid nozzle 14 having a non-conical internal projection 39. FIG. 19 is a perspective view of an alternate embodiment of the aerated fluid nozzle 14 not having an internal projection 39. If an internal projection 39 is used, the internal projection 39 can be any geometry, and preferably a geometry that cooperates with, and does not impede or overly impede, the fluid flow through the aerated fluid dispersion chamber 50. Similarly, if an internal projection 39 is used, the internal projection 39 can be any geometry, and preferably a geometry that cooperates with, and does not impede or overly impede, the wall geometry of the aerated fluid dispersion chamber 50.

Figure 20:
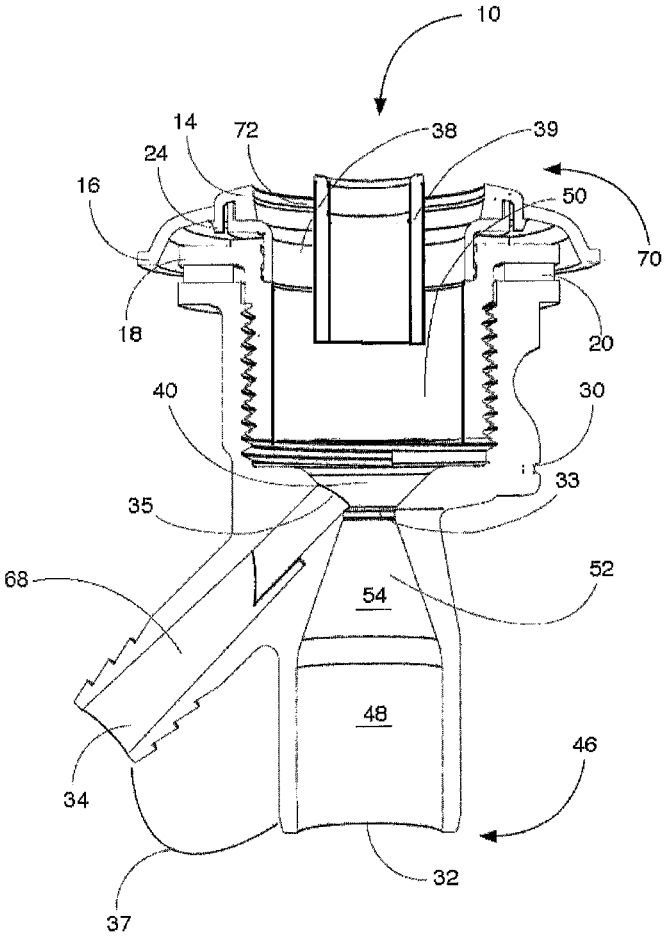
FIG. 20 is a side sectional view of the jet housing similar to FIG. 11, but with the alternate embodiment of the aerated fluid nozzle of FIG. 18.
Figure 21:
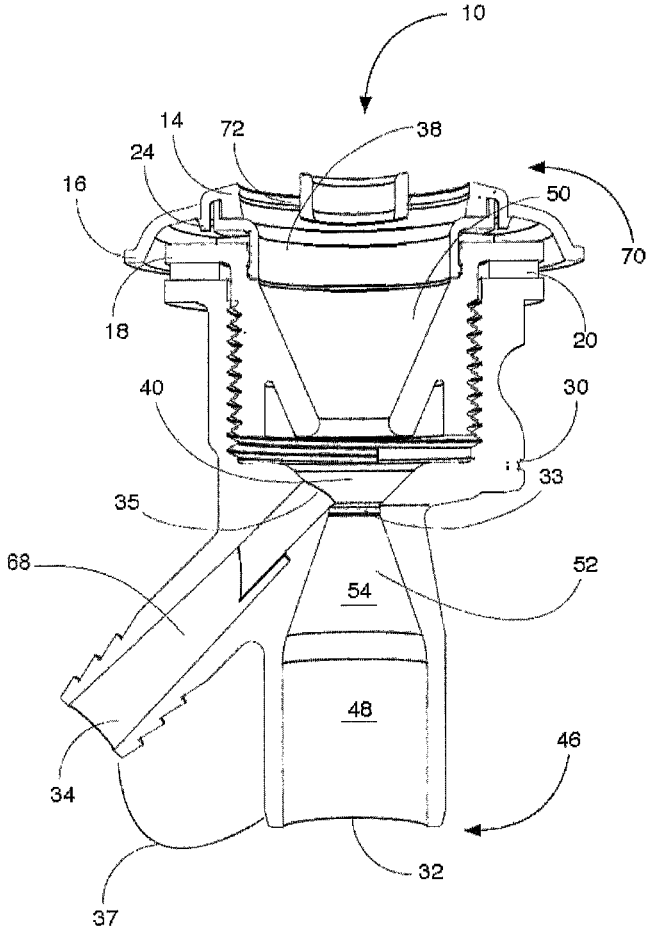
FIG. 21 is a side sectional view of the jet housing similar to FIG. 11, but with the alternate embodiment of the aerated fluid nozzle of FIG. 19.

FIG. 20 is a side sectional view of the jet housing 30 similar to FIG. 11, but with the alternate embodiment of the aerated fluid nozzle 14 of FIG. 18, and with a non-conical wall geometry of the aerated fluid dispersion chamber 50. FIG. 21 is a side sectional view of the jet housing 30 similar to FIG. 11, but with the alternate embodiment of the aerated fluid nozzle 14 of FIG. 19, with a conical wall geometry of the aerated fluid dispersion chamber 50. The wall geometry of the aerated fluid dispersion chamber 50 can be any geometry, and preferably a geometry that cooperates with, and does not impede or overly impede, the fluid flow through the aerated fluid dispersion chamber 50. Similarly, if an internal projection 39 is used, the wall geometry of the aerated fluid dispersion chamber 50 can be any geometry, and preferably either a geometry that cooperates with the internal projection 39 or cylindrical.

Normal water jets typically are too powerful to be used in this sensitive area, namely, normal water jets provide too strong of a flow rate of fluid. The unique high air content of the aerated fluid flow of the present system 10 provides a soft but effective massage therapy for such sensitive areas when combined with the therapy ring 12. The therapy ring 12 also can be used in hand and foot locations. The therapy ring 12 can be made in soft foam-like or rubber materials, or rigid materials depending on the type of massage intended.

Regardless of the specific architecture of the jet housing 30 and wall fitting 18, production of an aerated water jet requires at least one input point (inlet end 46) in fluid communication with at least one output point (outlet end 70). In the case of a jet housing 30 that is configured to produce an aerated fluid jet, the jet housing 30 also may require a second input point and at least one aeration chamber 40. It is envisioned that the aeration chamber 40 is interposed between the two input points and the output point and that the aeration chamber 40 is configured to, at least, mix a gas (from one input point 35) and a fluid (from the other input point 33) to form an aerated fluid.

Moreover, the jet housing 30 may be in fluid communication, and entirely operable to function according to its described configuration, with any engine, motor, compressor, pump, etc., known to one having ordinary skill in the art for use in water jet systems and applications. It is envisioned that the jet housing 30 may produce fluid flows with pressures and velocities appropriate for hydrotherapy tubs; however, the standard may be any field or category that would benefit from the applications of the present system 10. The pressures and velocities attainable by the present system 10 may also be sufficient to apply a therapeutic treatment to a system user; the therapeutic treatment providing appropriate combinations of pressures and jet flow momentum to massage sensitive tissue areas. More specifically, sensitive tissue areas include tissue areas affected by physiological conditions, such as carpel tunnel, gout, arthritis, repetitive motion disorder, tendon strains/ruptures, ligament strains/ruptures, etc.

The various embodiments are provided by way of example and are not intended to limit the scope of the disclosure. The described embodiments comprise different features, not all of which are required in all embodiments of the disclosure. Some embodiments of the present disclosure utilize only some of the features or possible combinations of the features. Variations of embodiments of the present disclosure that are described, and embodiments of the present disclosure comprising different combinations of features as noted in the described embodiments, will occur to persons with ordinary skill in the art. It will be appreciated by persons with ordinary skill in the art that the present disclosure is not limited by what has been particularly shown and described herein above. Rather the scope of the invention is defined by the appended claims.

LIST OF REFERENCE NUMERALS

10 system
12 therapy ring
12A smooth therapy ring
12B scalloped therapy ring
14 aerated fluid nozzle
14A two port face fan
14B three port face fan
14C multi-port face fan
16 flange
18 wall fitting
20 gasket
22 body
24 male snap components
26 female snap components
28 chairs
30 jet housing
32 fluid inlet zone
33 fluid inlet orifice
34 gas inlet zone
35 gas inlet orifice
36 fluid outlet channel
37 angled configuration element
38 aerated fluid outlet channel
39 internal projection, conical internal projection
40 aeration chamber
41 distal end of therapy ring
42 upper flange of jet housing
44 upper surface of wall fitting
46 inlet end of jet housing, inlet end of system
48 fluid manifold
50 aerated fluid dispersion chamber
52 interior of jet housing
54 constricting zone of jet housing
60 tub wall, shell
62 threaded portion of jet housing
64 threaded portion of wall fitting
66 attachment section of wall fitting
68 gas manifold
70 outlet end of system
72 ports on aerated fluid nozzle
74 clip projections of therapy ring
76 cylindrical projection of flange

What is claimed is:

1. A system for jet hydrotherapy comprising:
a) a jet housing that comprises:
i) an aeration chamber;
ii) a fluid inlet providing a fluid flow into the jet housing;
iii) a fluid inlet orifice configured to provide the fluid flow to the aeration chamber, the fluid flow having an increased velocity and a decreased pressure as it passes through a constriction between the fluid inlet and the aeration chamber and into the aeration chamber; and
iv) a gas inlet orifice configured to provide a gas flow into the aeration, chamber, the gas inlet orifice being located adjacent to the fluid inlet orifice;
wherein the fluid and the gas mix in the aeration chamber to produce an aerated fluid flow of between 40% and 90% gas;
b) an aerated fluid dispersion chamber for receiving the aerated fluid flow from the aeration chamber; and
c) an aerated fluid nozzle for providing the aerated fluid flow to a tub, the aerated fluid nozzle being located proximal to an end of the aerated fluid dispersion chamber having the greatest diameter,
wherein the aeration chamber is a venturi chamber having an increasing diameter in the direction of the aerated fluid flow, and wherein the aeration chamber has an internal geometry such that the gas flow and the fluid flow merge to form a vortical flow directed towards an aerated fluid outlet channel.

2. The system for jet hydrotherapy of claim 1, wherein the aerated fluid flow is between 70% and 90% gas.

3. The system for jet hydrotherapy of claim 1, wherein the fluid flow into the jet housing is substantially parallel to the axis of the jet housing and the gas flow being provided to the aeration chamber is at an angle of between 30 degrees and 60 degrees relative to the fluid flow.

4. The system for jet hydrotherapy of claim 1, wherein the jet housing additionally comprises a fluid inlet manifold having a first diameter greater than the diameter of the fluid inlet orifice and a constriction zone between the fluid inlet manifold and the fluid inlet orifice and having a diameter that narrows from the first diameter of the fluid inlet manifold to the diameter of the fluid inlet orifice.

5. The system for jet hydrotherapy of claim 1, wherein the aerated fluid nozzle is detachable.

6. The system for jet hydrotherapy of claim 1, further comprising a therapy ring surrounding the aerated fluid nozzle.

7. The system for jet hydrotherapy of claim 6, wherein the therapy ring is detachable.

8. The system for jet hydrotherapy of claim 6, wherein the therapy ring is ergonomically configured to engage with a user's tissue.

9. The system for jet hydrotherapy of claim 1, further comprising a flange that attaches to the aerated fluid dispersion chamber at a location proximal to an end of the aerated fluid dispersion chamber having the greatest diameter.

10. The system for jet hydrotherapy of claim 1, wherein the aerated fluid dispersion chamber has an increasing diameter in the direction of flow of the aerated fluid flow.

11. The system for jet hydrotherapy of claim 10, further comprising an internal projection extending from the aerated fluid nozzle into the aerated fluid dispersion chamber, the internal projection also having an increasing diameter in the direction of flow of the aerated fluid flow generally increasing at the same rate as the increasing diameter of the aerated fluid dispersion chamber.

12. The system for jet hydrotherapy of claim 1, further comprising an internal projection extending from the aerated fluid nozzle into the aerated fluid dispersion chamber.

13. A system for jet hydrotherapy comprising:
a) a jet housing that comprises:
i) an aeration chamber;
ii) a fluid inlet providing a fluid flow into the jet housing;
iii) a fluid inlet orifice configured to provide the fluid flow to the aeration chamber, the fluid flow having an increased velocity and a decreased pressure as it passes through a constriction between the fluid inlet and the aeration chamber and into the aeration chamber; and iv) a gas inlet orifice configured to provide a gas flow into the aeration, chamber, the gas inlet orifice being located adjacent to the fluid inlet orifice;

wherein the fluid and the gas mix in the aeration chamber to produce an aerated fluid flow of between 40% and 90% gas;

b) a wall fitting comprising an aerated fluid dispersion chamber for receiving the aerated fluid flow from the aeration chamber;

c) an aerated fluid nozzle for providing the aerated fluid flow to a tub, the aerated fluid nozzle being located proximal to an end of the aerated fluid dispersion chamber having the greatest diameter; and d) an internal projection extending from the aerated fluid nozzle into the aerated fluid dispersion chamber, wherein the wall fitting cooperates with the jet housing to hold the wall fitting and the jet housing onto a wall of the hydrotherapy tub, and wherein the aeration chamber is a venturi chamber having an increasing diameter in the direction of the aerated fluid flow, and wherein the aeration chamber has an internal geometry such that the gas flow and the fluid flow merge to form a vortical flow directed towards an aerated fluid outlet channel.

14. The system for jet hydrotherapy as claimed in claim 13, further comprising a flange that attaches to the wall fitting at a location proximal to an end of the aerated fluid dispersion chamber having the greatest diameter.

15. The system for jet hydrotherapy of claim 14, wherein the aerated fluid nozzle is detachably attached to the flange.

16. The system for jet hydrotherapy of claim 14, further comprising a therapy ring surrounding the aerated fluid nozzle, wherein the therapy ring is detachably attached to the flange.

17. The system for jet hydrotherapy of claim 16, wherein the therapy ring is ergonomically configured to engage with a user's tissue.

18. The system for jet hydrotherapy of claim 13, wherein the jet housing additionally comprises a fluid inlet manifold having a first diameter greater than the diameter of the fluid inlet orifice and a constriction zone between the fluid inlet manifold and the fluid inlet orifice and having a diameter that narrows from the first diameter of the fluid inlet manifold to the diameter of the fluid inlet orifice.

19. The system for jet hydrotherapy of claim 13, wherein the aerated fluid dispersion chamber has an increasing diameter in the direction of flow of the aerated fluid flow.

20. The system for jet hydrotherapy of claim 19, wherein the internal projection also has an increasing diameter in the direction of flow of the aerated fluid flow generally increasing at the same rate as the increasing diameter of the aerated fluid dispersion chamber.

21. The system for jet hydrotherapy of claim 13, wherein the fluid flow into the jet housing is substantially parallel to the axis of the jet housing and the gas flow being provided to the aeration chamber is at an angle of between 30 degrees and 60 degrees relative to the fluid flow.

* * * * *